US008718286B2

(12) United States Patent
Spielbauer et al.

(10) Patent No.: US 8,718,286 B2
(45) Date of Patent: May 6, 2014

(54) AUDIO CONNECTION TESTING SYSTEM

(75) Inventors: Georg Spielbauer, Haselbach (DE); Max Granger, Straubing (DE); Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 2093 days.

(21) Appl. No.: 11/761,786

(22) Filed: Jun. 12, 2007

(65) Prior Publication Data

US 2007/0291952 A1 Dec. 20, 2007

(30) Foreign Application Priority Data

Jun. 14, 2006 (EP) ..... 06012316

(51) Int. Cl.
*H04R 29/00* (2006.01)

(52) U.S. Cl.
USPC ..... 381/59; 381/56; 381/122; 708/322

(58) Field of Classification Search
CPC .. H04R 29/001; H04R 29/00; H04R 2410/00; H03H 21/0043; H03H 21/0012; H03H 21/0001; G01R 31/041; G01R 31/02
USPC ..... 381/58, 59, 77, 96, 95, 56, 122, 86; 708/322, 200, 300, 422
See application file for complete search history.

(56) References Cited

U.S. PATENT DOCUMENTS

2003/0073408 A1 4/2003 Harrell et al.
2004/0131194 A1 7/2004 Gruhle et al.

FOREIGN PATENT DOCUMENTS

EP 1 253 804 A2 10/2002
JP 11-167383 6/1999

*Primary Examiner* — Vivian Chin
*Assistant Examiner* — Con P Tran
(74) *Attorney, Agent, or Firm* — O'Shea Getz P.C.

(57) ABSTRACT

A testing system tests an audio connection between an audio source and a loudspeaker. The system includes a loudspeaker that converts a reference signal into a sound. An adaptive filter processes the reference signal to minimize an error signal. A decision circuit analyzes the error signal and the received signal to determine signal correlation. When the signals are not correlated, a defect is detected.

22 Claims, 7 Drawing Sheets

AUDIO CONNECTION TESTING SYSTEM

PRIORITY CLAIM

This application claims the benefit of priority from European Patent Application No. 06012316.3, filed Jun. 14, 2006, which is incorporated by reference.

BACKGROUND OF THE INVENTION

1. Technical Field

This application relates to a testing system, and more particularly to a system that assures continuity.

2. Related Art

When installing an audio system, the connection between an audio source and the loudspeaker may be assured. When the connection between the audio source and/or the loudspeaker itself fails, a user may notice a the failure.

Some systems use level-based measurements to test audio connections. In these systems, an audio source transmits a reference signal to a loudspeaker. A receiving device measures the sound delivered by the loudspeaker, and a receiver detects and analyzes the quality of the signal.

When testing loudspeakers, some methods adjust the tolerance range to compensate for the characteristics of the loudspeaker and/or the receiving device. Additionally, some systems must be recalibrated when a loudspeaker and/or receiving device is replaced. Therefore, a need exists for an improved audio evaluation system.

SUMMARY

A testing system tests an audio connection between an audio source and a loudspeaker. The system includes a loudspeaker that converts a reference signal into a sound. An adaptive filter processes the reference signal to minimize an error signal. A decision circuit analyzes the error signal and the received signal to determine signal correlation. When the signals are not correlated, a defect is detected.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
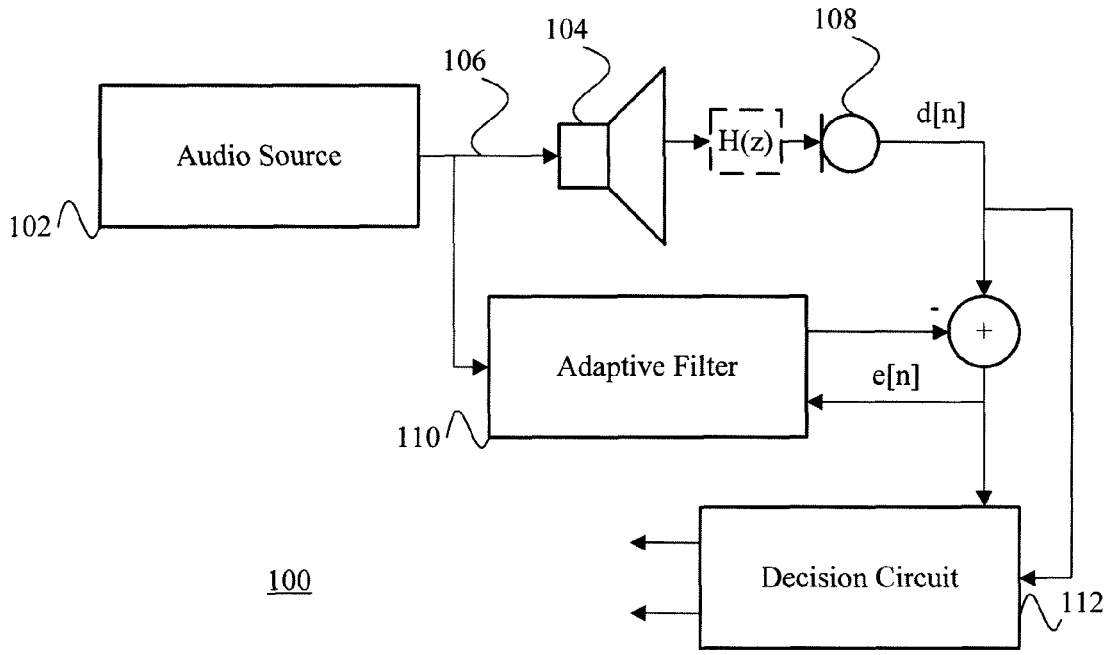
FIG. 1 is a block diagram of an audio connection testing system.

FIG. 1 is a block diagram of an audio connection testing system 100 that tests an audio connection between an audio source 102 and a loudspeaker 104. The system may comprise an audio source 102, a loudspeaker 104, a receiver 108, an adaptive filter 110, and a decision circuit 112. The audio source 102 is in communication with the loudspeaker 104 and the adaptive filter 110 through a signal path 106 that carries a reference signal, x[n]. The signal path 106 may comprise a wired or wireless connection. Wireless connections may use 802.11b, 802.11j, 802.11g, 802.11n draft, 802.11x, ZigBee, Ultra Wide Band, Mobile Fi, or other wireless protocols.

An area between the loudspeaker 104 and the receiver 108 has a characteristic H(z). H(z) represents the amount by which a room attenuates and or phase shifts components of a signal transmitted through this area. In FIG. 1, the receiver 108 may be a device that converts sound into electrical signals or digital data, d[n]. An error signal, e[n], is generated and received by the adaptive filter 110. The coefficients of the adaptive filter 110 may change to minimize the error signal. When the filter coefficients are updated or after some predetermined time, the error signal, e[n], and the received signal, d[n], are processed by the decision circuit 112. The decision circuit 112 may determine whether the received signal and the error signal are correlated, and may indicate the state of the audio connection between the audio source 102 and the loudspeaker 104. When a correlation exists, the audio connection between the audio source 102 and the loudspeaker 104 may be acceptable. When there is little or no correlation between the signals, a defect may be detected between the audio source 102 and the loudspeaker 104 (e.g., that a connection between the audio source 102 and the loudspeaker 104 may be interrupted at some point, or that the loudspeaker itself may be defective).

Figure 2:
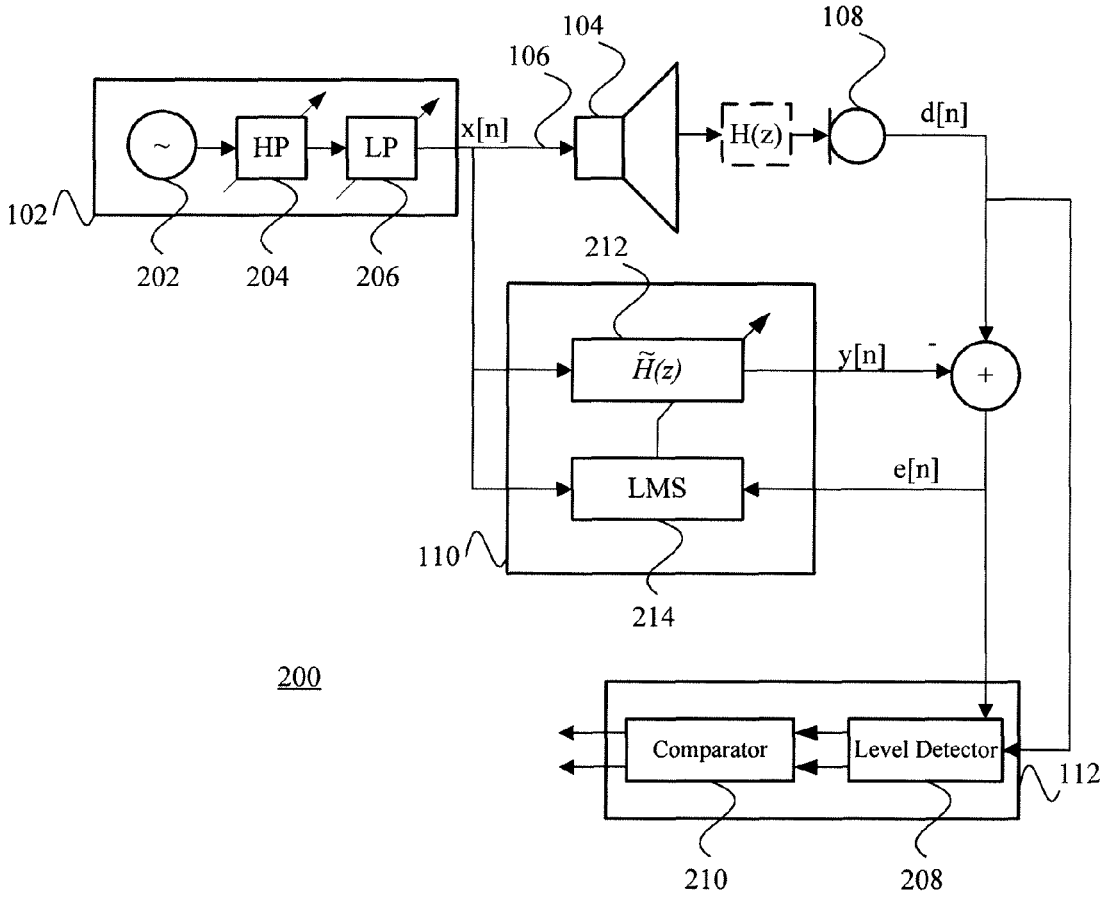
FIG. 2 is a second block diagram of an audio connection testing system

FIG. 2 shows an audio connection testing system 200 that tests an audio connection between an audio source 102 and a loudspeaker 104. In FIG. 2, the audio source 102 comprises a signal source 202, a high-pass filter 204, and a low pass filter 206. The signal source 202 generates the reference signal, x[n]. The reference signal, x[n], may be a white noise; a pseudorandom sequence of sound pulses, such as a Maximum Length Sequence ("MLS"); a speech signal; a music signal; a superposition of signals with specific or non-specific frequencies; a sine wave; a sine sweep; and/or other types or combinations of signals. The high pass 204 and low pass 206 filters in FIG. 2 may be variable filters that may be activated or deactivated individually or in combination. The selectivity of the high pass 204 and low pass 206 filters allows the system to provide a reference signal that is within a frequency response range of the loudspeaker 104. If an audio connection to a broadband loudspeaker is tested, the high pass filter 204 and/or low pass filter 206 may be configured to process components of the reference signal, x[n], below about 20 kHz and above about half of a sampling rate (e.g., Nyquist frequency). Alternatively, if an audio connection to a high frequency loudspeaker, such as a tweeter, is tested, the high pass filter 204 and/or low pass filter 206 may process components of the reference signal, x[n], below about 19 kHz and above about half of a sampling rate.

In FIG. 2, the adaptive filter 110 comprises an impulse response generator 212 and adaptation logic 214. The adaptive filter 110 processes the reference signal, x[n], and the error signal, e[n], into a filtered signal, y[n]. In FIG. 2, the error signal, e[n], is obtained by subtracting the filtered signal, y[n], from the received signal, d[n]. In some systems, other processes may be used to obtain the error signal, e[n]. The adaptation logic 214 may use the reference signal, x[n], and the error signal, e[n], to update the filter coefficients of the impulse response generator 212 to minimize the error signal. In FIG. 2, the adaptation logic 214 may comprise a Least Mean Square ("LMS") circuit, a Normalized Least Mean Square ("NLMS") circuit, a Recursive Least Square ("RLS") circuit, or other recursive circuits. Depending on the implementation, the adaptive filter 110 may be implemented in the time-domain or in the frequency domain. Input and output signals may be processed pre and post transformation circuits that transform a signal between the time and frequency domains.

The error signal, e[n], and the received signal, d[n], may be processed by the decision circuit 112. The decision circuit 112 may include a level detector 208 and a comparator 210. The level detector 208 may quantify (e.g., translate into a numerical value) the error signal and the received signal. In some systems, the level detector 208 may have one or more infinite impulse response ("IIR") low pass filters. The IIR low pass filters may be of first order having a time constant (e.g. smoothing coefficient) of about 0.99995. The error signal, e[n], and the received signal, d[n], may be processed by the same or different IIR low pass filters to determine a level of the respective signal. Choosing a time constant that is not too small helps the system avoid significant filter fluctuations. Alternatively, the level detector 208 may include other hardware and/or software that provide a level of the error signal, e[n], and/or the received signal, d[n].

The comparator 210 compares the error signal, e[n], and the received signal, d[n]. When the error signal is smaller than the received signal, a correlation exists between the reference signal, x[n], and the received signal, d[n]. A correlation indicates that the audio connection between the audio source 102 and the loudspeaker 104 is functional (e.g., there is a connection between the audio source 102 and the loudspeaker 2). When the error signal is larger than the received signal, no correlation exists between the reference signal, x[n], and the received signal, d[n]. This condition indicates a defect between the audio source 102 and the loudspeaker 104.

The reliability of a system may be increased by evaluating the level of the correlation between the error signal, e[n], and the received signal, d[n]. The comparator 210 may determine whether the error signal, e[n], is smaller than the received signal, d[n], by a predetermined or programmed threshold. In some systems, the threshold may range between about 0 decibels ("dB") and about 4 dB, and in some applications may range between about 0.5 dB and about 3.5 dB. In other systems, the threshold may be about 3 dB. When a threshold is set, the system may indicate that an audio connection is functional when the error signal, e[n], is smaller than the received signal, d[n], by at least the threshold. To provide additional data, the comparator 210 may generate an audio and/or visual signal that indicates the difference between the error signal, e[n], and the received signal, d[n].

Figure 3:
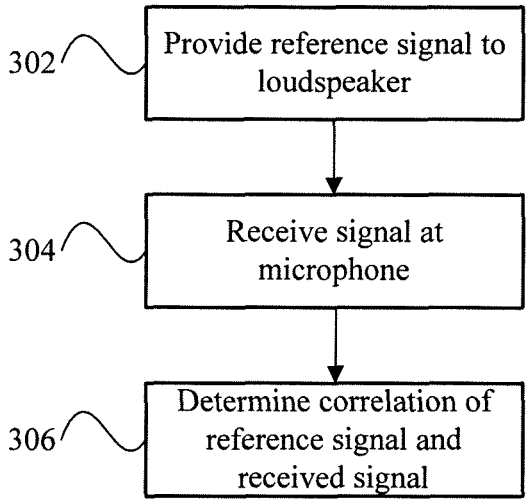
FIG. 3 is a flow diagram of a method that tests an audio connection.

FIG. 3 is a flow diagram of a method that tests an audio connection. At act 302, a reference signal is received by a loudspeaker. The reference signal may be a white noise, a MLS, a sine wave, a sine sweep, a music signal, a speech signal, a superposition of signals with specific or non-specific frequencies, or types or combinations of signals. In some systems, the reference signal or frequency range of the reference signal may depend on the type of loudspeaker tested. When testing a passively coupled tweeter, a reference signal may be selected in a frequency range between about 19 kHz and about half of a sampling rate. Alternatively, for a passively coupled tweeter, a reference signal may be selected in a frequency range with a higher lower limit frequency such as about 21 kHz. The selection of this reference signal may reduce signals from being transmitted by a midrange loudspeaker. When working with such a frequency range, the receiver in some systems is positioned such that signals output from the loudspeaker directly reach the receiver as in this frequency range there may be little diffraction.

At act 304, a receiver, such as a microphone or measuring microphone, detects loudspeaker output which may include at least a portion of the reference signal and/or other signals. The receiver may convert these acoustic signals into an analog signal or digital data. If the connection between the audio source and the loudspeaker, and/or the loudspeaker, is functional, the signals received at the microphone will comprise at least a portion of the reference signal. At act 306, the system determines whether there is a correlation between the reference signal and the received signal.

Figure 4:
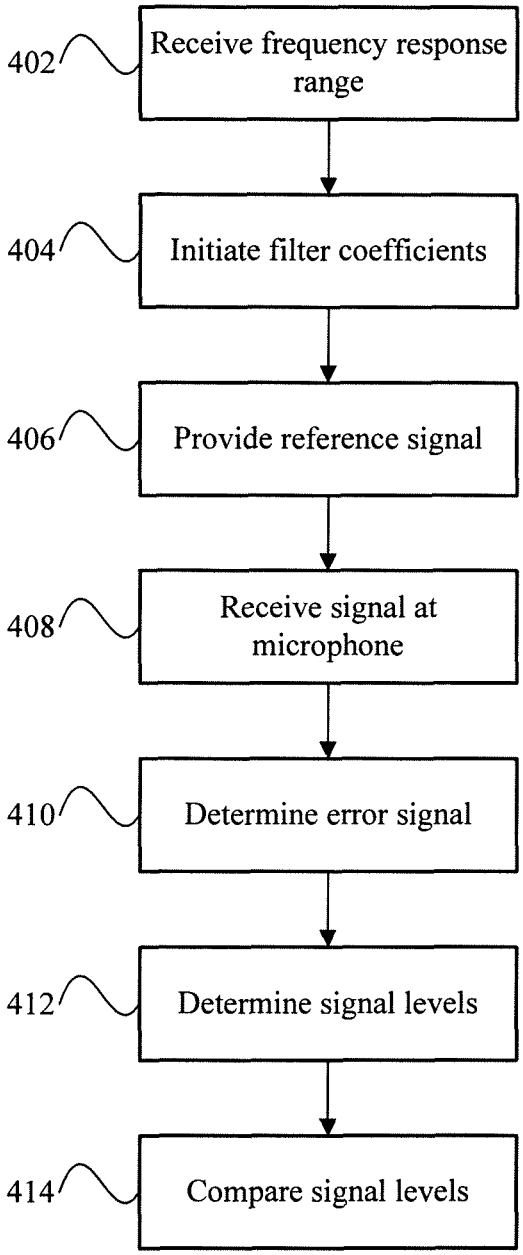
FIG. 4 is a second flow diagram of a method that tests an audio connection.

FIG. 4 is a flow diagram of an alternative method that tests an audio connection. At act 402, the frequency range of a loudspeaker is received. The frequency range may be automatically detected or manually entered. Alternatively, the frequency range may be supplied by a local or remote standalone computer or controller that may execute various applications in communication with the system.

At act 404, the filter coefficients of the adaptive filter may be initialized. The initialized value may be selected from a prior adaptation of the filter. In some systems, the initialized value may lie between about 0.005 and about 0.025, and may be about 0.015.

In some systems, the filter coefficients are initialized to a value that corresponds to values used in a prior adaptation. In some applications, when a defective audio connection exists, the values of the filter coefficients will approach zero during the adaptation process. When the adaptive process is completed, the error signal level and the received signal level may approach similar values, and the difference between the error signal and the reference signal may approach zero. If the adaption time is selected such that the final adaptive state is not reached then the error signal level will be greater than the received signal level and the difference between the error signal and the reference signal will result in a negative value. When the audio connection is functional, the filter coefficients approach non-zero values, and the difference between the error signal and the reference signal will have a positive value.

At act 406, a reference signal within the frequency response range of the loudspeaker is generated. The reference signal may be a white noise, a MLS, a sine wave, a sine sweep, a music signal, a speech signal, a superposition of signals with specific or non-specific frequencies, or other types or combinations of signals. The reference signal may be filtered through a high pass and/or low pass filter so that it is within the passband of the loudspeaker.

At act 408, a microphone or a measuring microphone detects the audio signal from the loudspeaker. If the audio connection is operational, the received signal may include a portion of the reference signal, and the received signal will correlate with the reference signal. If the audio connection is defective, the received signal may not correlate with the reference signal.

At act 410, an error signal representing the difference between a desired signal and an estimated signal is determined. In some systems, the error signal may be determined by subtracting the adaptively filtered reference signal from the received signal. Alternatively, other hardware and/or software may be used to determine the error signal. In some applications, the filter adaptation may not reach equilibrium. In these applications, the level of the error signal may be greater than the level of the microphone signal when a defective audio connection is detected.

At act 412, the signal levels of the received signal and the error signal are determined. This act may be performed at a programmed time after the adaptive filter has adapted its coefficients. In some systems, the adaptation may occur between about 0.003 and about 0.01 intervals. In some systems, the signal levels are measured during about a one second period. Other adaptation intervals and/or adaptation periods may be selected based on a desired implementation.

At act 414, the signal levels of the error signal and the received signal are compared. In some systems, the comparison may comprise subtracting the error signal from the received signal. Some systems may use circuitry and/or software to determine the difference between the signal levels. When the error signal level is smaller than the received signal level, a correlation is detected, and the audio connection between the audio source and the loudspeaker may be determined to be operational. When the error signal level is larger than the received signal level, no correlation may exist between the reference signal and the received signal. In this state, a defect may be detected.

Figure 5:
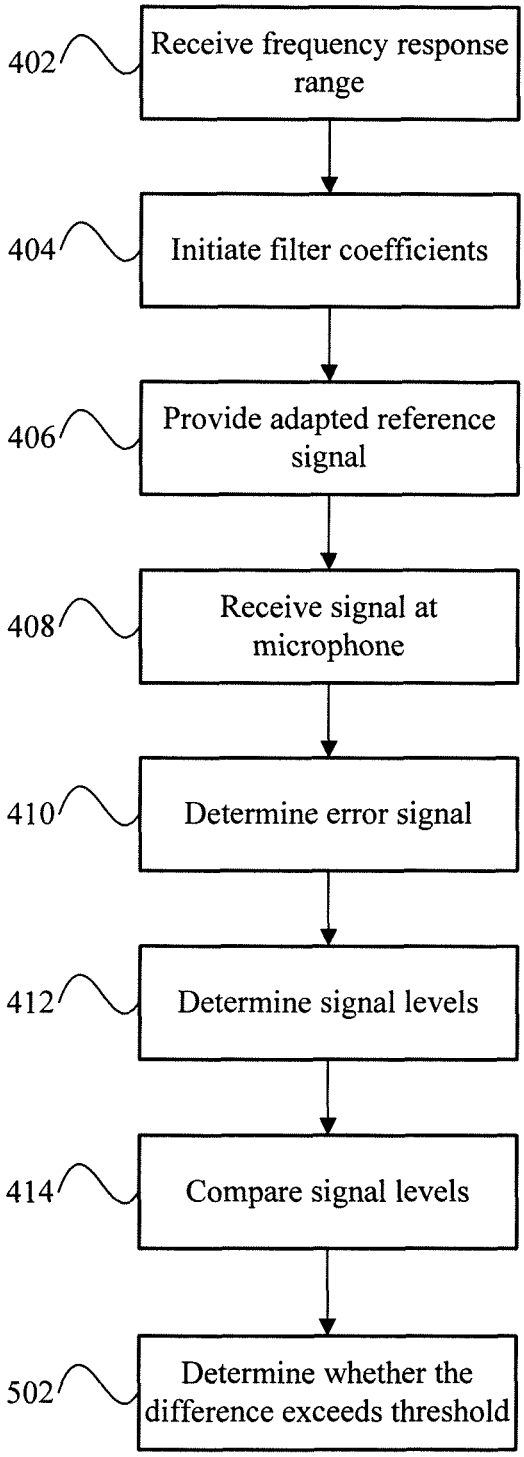
FIG. 5 is a third flow diagram of a method that tests an audio connection.

FIG. 5 is a third flow diagram of a method that tests an audio connection. At act 502 the method determines whether the received signal level exceeds the error signal level by a predetermined or programmed threshold. In some systems, a threshold of about 3 dB may be used. The result may be shown through a display, light emitting diode, or other audio and/or visual devices. This result may be stored in a local or remote memory.

Figure 6:
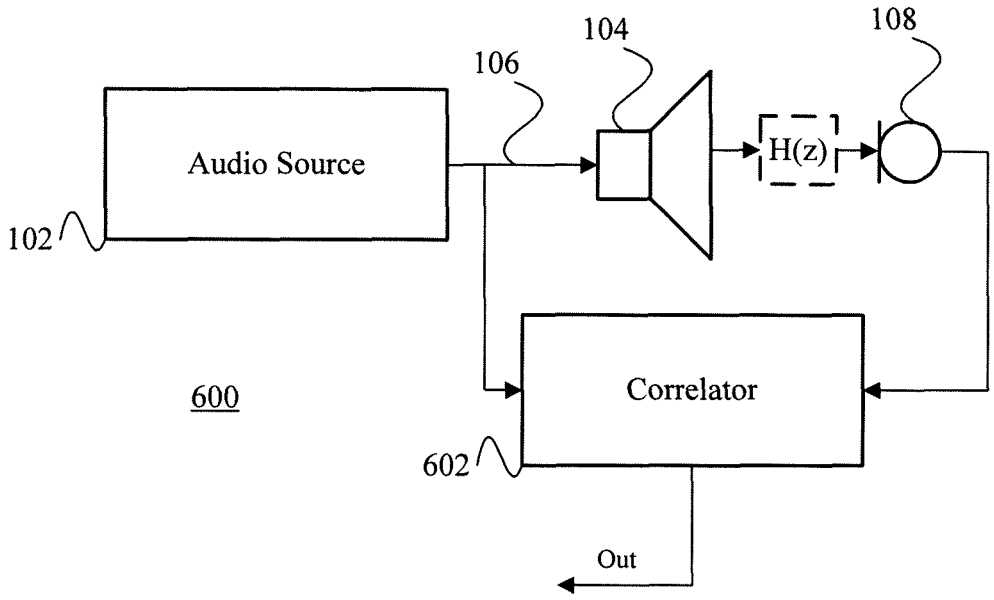
FIG. 6 is a third block diagram of an audio connection testing system.
Figure 7:
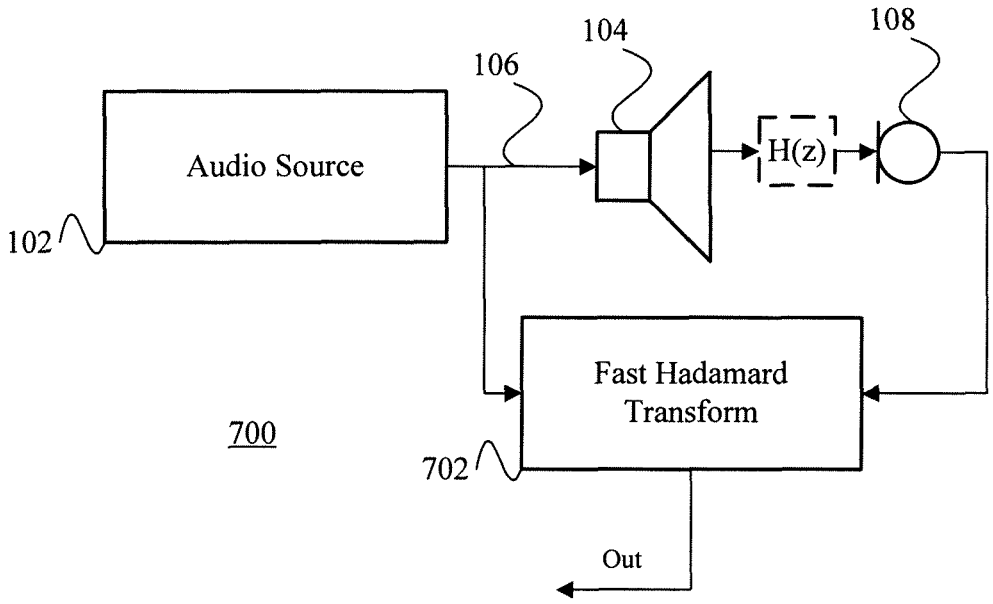
FIG. 7 is a fourth block diagram of an audio connection testing system.

FIG. 6 is a third block diagram of an audio connection testing system 600. In FIG. 6 a correlator 602 is used to determine a direct cross-correlation between the reference signal and the received signal. In FIG. 7, system 700 uses a Fast Hadamard Transform 702 to determine the correlation between an MLS reference signal and the received signal. A Fast Hadamard Transform 702 may improve the processing speed of the system. In some systems, the Fast Hadamard Transform 702 may be in communication with or an integral part of the correlator 602 of FIG. 6.

Figure 8:
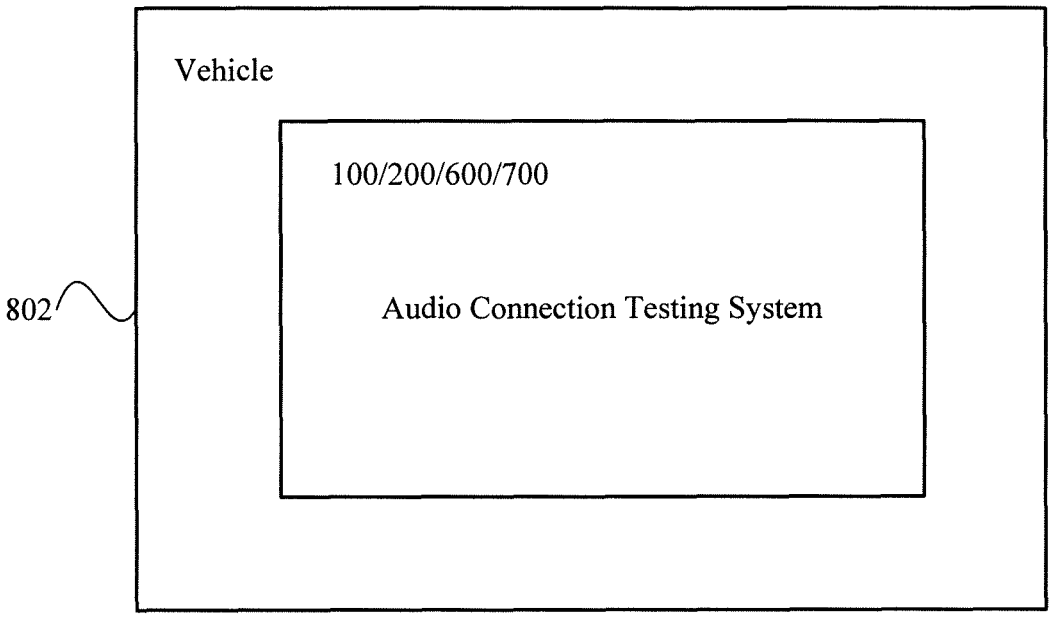
FIG. 8 is an audio connection testing system within a vehicle.

The audio connection testing system is adaptable to many technologies and/or devices. Some systems interface or couple devices used to transport persons and/or things, such as a vehicle 802 shown in FIG. 8. When installed within a vehicle, an audio and/or visual system such as a compact disc player, audio system, infotainment system, entertainment system, handsfree system, or other devices may be used to generate the reference signal. Many of these systems may include an adaptive filter that may be used to generate an error signal. Therefore, audio connections within the vehicle 802 may be tested with little or no additional processing power and/or memory. When the system is incorporated into a vehicle 802 it may be part of an on-board computer, such as an electronic control unit, an electronic control module, and a body control module. In other applications, the system may be a separate after factory unit that may communicate with the existing circuitry of the vehicle 802 using one or more allowable protocols. Some of the protocols may include J1850VPW, J1850PWM, ISO, ISO914102, ISO14230, CAN, High Speed CAN, MOST, LIN, IDB-1394, IDB-C, D2B, Bluetooth®, or the protocol marketed under the trademark FlexRay.

Each of the processes described may be encoded in a computer readable medium such as a memory, programmed within a device such as one or more integrated circuits, one or more processors or may be processed by a controller or a computer. If the processes are performed by software, the software may reside in a memory resident to or interfaced to a storage device, a communication interface, or non-volatile or volatile memory in communication with a transmitter. The memory may include an ordered listing of executable instructions for implementing logic. Logic or any system element described may be implemented through optic circuitry, digital circuitry, through source code, through analog circuitry, or through an analog source, such as through an electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any device that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

Although selected aspects, features, or components of the implementations are described as being stored in memories, all or part of the systems, including processes and/or instructions for performing processes, consistent with the system may be stored on, distributed across, or read from other machine-readable media, for example, secondary storage devices such as hard disks, floppy disks, and CD-ROMs; a signal received from a network; or other forms of ROM or RAM resident to a processor or a controller.

Specific components of a system may include additional or different components. A controller may be implemented as a microprocessor, microcontroller, application specific integrated circuit (ASIC), discrete logic, or a combination of other types of circuits or logic. Similarly, memories may be DRAM, SRAM, Flash, or other types of memory. Parameters (e.g., conditions), databases, and other data structures may be separately stored and managed, may be incorporated into a single memory or database, or may be logically and physically organized in many different ways. Programs and instruction sets may be parts of a single program, separate programs, or distributed across several memories and processors.

While various embodiments of the invention have been described, it will be apparent to those of ordinary skill in the art that many more embodiments and implementations are possible within the scope of the invention. Accordingly, the invention is not to be restricted expect in light of the attached claims and their equivalents.

We claim:

1. A method of testing an audio connection between an audio source and a loudspeaker, comprising:

receiving a reference signal at a loudspeaker;

transmitting a signal through the loudspeaker;

receiving the signal at a microphone;

filtering adaptively the reference signal and generating an error signal;

determining the level of the received signal and of the error signal; and determining whether the error signal level is less than the received signal level, where the signal comprises a portion of the reference signal that has been filtered.

2. The method of claim 1, where the act of determining whether the error signal level is less than the received signal level comprises determining whether the error signal level is smaller than the received signal level by at least a predetermined threshold.

3. The method of claim 2, where the predetermined threshold is greater than about 0 dB and smaller than about 4 dB.

4. The method of claim 2, where the act of filtering adaptively comprises applying one of a Least Means Square circuit, a Normalized Least Means Square circuit, and a Recursive Least Means Square circuit.

5. The method of claim 2, further comprising initializing adaptive filter coefficients to a value of between about 0.005 and about 0.025.

6. The method of claim 1, where the reference signal comprises one of a white noise, a Maximum Length Sequence, a sine wave, a sine sweep, and a music signal.

7. The method of claim 1, further comprising receiving a frequency response range of the loudspeaker.

8. The method of claim 7, where the act of providing the reference signal to the loudspeaker further comprises providing a reference signal within the received frequency response range.

9. The method of claim 1, where the reference signal comprises a signal filtered by a high pass filter.

10. The method of claim 1, where the reference signal comprises a signal filtered by a low pass filter.

11. The method of claim 1, where the loudspeaker comprises a tweeter.

12. A tangible non-transitory computer readable storage medium containing a set of instructions that executes a method of testing an audio connection between an audio source and a loudspeaker, comprising:

receiving a reference signal at a loudspeaker;

transmitting a signal through the loudspeaker;

receiving the signal at a microphone;

filtering adaptively the reference signal and generating an error signal;

determining the level of the received signal and of the error signal; and determining whether the error signal level is less than the received signal level, where the signal comprises a portion of the reference signal that has been filtered.

13. An audio connection testing system, comprising:

a loudspeaker configured to receive a reference signal;

a receiver that receives a signal output by the loudspeaker;

an adaptive filter that adaptively filters the reference signal and minimizes an error signal representing a difference between the reference signal and the received signal; and a decision circuit that analyzes the error signal and the received signal and determines whether the error signal and the received signal are correlated, where the signal comprises a portion of the reference signal that has been filtered.

14. The system of claim 13, where the decision circuit comprises a level detector that detects a level of the received signal.

15. The system of claim 14, where the decision circuit further comprises a level detect that detects a level of the error signal.

16. The system of claim 15, where the decision circuit further comprises a comparator that determines whether the error signal level is less than the received signal level.

17. The system of claim 16, where the comparator is further configured to determine whether the error signal level is less than the received signal level by at least a predetermined threshold.

18. System according to claim 17, where the predetermined threshold is greater than about 0 dB and smaller than about 4 dB.

19. The system of claim 13, where the adaptive filter comprises one of a Least Means Square circuit, a Normalized least Means Square circuit, and a Recursive Least Square circuit.

20. The system of claim 13, where the adaptive filter is further configured to have initial filter coefficients of between about 0.005 and about 0.025.

21. The system of claim 13, where the reference signal comprises one of a white noise, a Maximum Length Sequence, a sine wave, a sine sweep, and a music signal.

22. The system of claim 13, where the reference signal comprises a signal within a frequency response range of the loudspeaker.

* * * * *